US005359401A

United States Patent [19]

Uehara et al.

[11] Patent Number: 5,359,401

[45] Date of Patent: Oct. 25, 1994

[54] FIXING DEVICE

[75] Inventors: Yasuhiro Uehara; Yasuhiro Kusumoto; Shohzoh Yamamoto, all of Ebina, Japan

[73] Assignee: Fuji Xerox Co., Ltd., Tokyo, Japan

[21] Appl. No.: 139,770

[22] Filed: Oct. 22, 1993

[30] Foreign Application Priority Data

Feb. 25, 1993 [JP] Japan ..... 5-036699

[51] Int. Cl.[5] ..... G03G 15/20

[52] U.S. Cl. ..... 355/285; 355/289; 355/290; 355/295; 219/216; 430/126

[58] Field of Search ..... 355/282, 285, 289, 290, 355/295; 219/216; 430/98, 99, 124, 126

[56] References Cited

U.S. PATENT DOCUMENTS

| | | | |
|---|---|---|---|
| 3,637,976 | 1/1972 | Ohta et al. | 219/216 |
| 3,997,262 | 12/1976 | Doi | 219/216 X |
| 4,682,878 | 7/1987 | Takizawa et al. | 355/282 X |
| 5,070,373 | 12/1991 | Fukano et al. | 355/290 |

FOREIGN PATENT DOCUMENTS

| | | | |
|---|---|---|---|
| 52-69337 | 6/1977 | Japan . | |
| 60-104852 | 7/1985 | Japan . | |
| 60-151677 | 8/1985 | Japan . | |
| 60-151681 | 8/1985 | Japan . | |
| 0130973 | 6/1986 | Japan | 355/290 |
| 62-14675 | 1/1987 | Japan . | |
| 2-30961 | 2/1990 | Japan . | |
| 0074976 | 3/1990 | Japan | 355/290 |
| 0109080 | 4/1990 | Japan | 355/290 |
| 0210480 | 8/1990 | Japan | 355/290 |
| 0222980 | 9/1990 | Japan | 355/290 |
| 3-252097 | 11/1991 | Japan . | |
| 0050885 | 2/1992 | Japan | 355/290 |

*Primary Examiner*—Matthew S. Smith
*Attorney, Agent, or Firm*—Oliff & Berridge

[57] ABSTRACT

A fixing device includes a contact portion formed by making a part of an endless belt supported by a plurality of tension rollers contact a fixing roller having an elastic body applied thereon. The contact portion includes a contact point formed by making a pressure roller inside the endless belt bear against the fixing roller under pressure through the endless belt at an exit point of the contact portion. The fixing device also includes a braking device which brakes the transport of the endless belt at the contact point such that the endless belt at the point where the pressure roller bears against the fixing roller moves at a speed greater than the remaining portions of the endless belt.

7 Claims, 6 Drawing Sheets

| THE SPEED AT WHICH THE BELT IS DRIVEN FORCIBLY [mm/s] | REDUCTION OF THE BELT SPEED WITH RESPECT TO THE DRIVEN SPEED | A/ε (ε=0.04) | IMAGE DISPLACEMENT |
|---|---|---|---|
| 246 | 0.032 | 8/10 | * |
| 247 | 0.028 | 7/10 | ** |
| 248 | 0.024 | 6/10 | ** |
| 249 | 0.02 | 5/10 | *** |
| 250 | 0.016 | 4/10 | *** |
| 251 | 0.012 | 3/10 | *** |
| 252 | 0.008 | 2/10 | *** |
| 253 | 0.004 | 1/10 | ** |
| 153.5 | 0.002 | 1/20 | ** |
| 254 | 0 | 0 | * |

* IMAGE DISPLACEMENT OCCURRED

** IMAGE DISPLACEMENT OCCURRED BUT THERE WAS NO PROBLEM IN RESPECT OF IMAGE QUALITY.

*** NO IMAGE DISPLACEMENT

FIG. 3

| STANDARD VALUE | BRAKING TORQUE | AMOUNT OF APPLIED BRAKING TORQUE IN PERCENT | IMAGE DISPLACEMENT |
|---|---|---|---|
| 50 | 0 | 0 | * |
| | 0.5 | 1/100 | ** |
| | 1.0 | 2/100 | ** |
| | 2.0 | 4/100 | *** |
| | 3.0 | 6/100 | *** |
| | 4.0 | 8/100 | *** |
| | 5.0 | 10/100 | *** |

* IMAGE DISPLACEMENT OCCURRED

** IMAGE DISPLACEMENT OCCURRED BUT THERE WAS NO PROBLEM IN RESPECT OF IMAGE QUALITY.

*** NO IMAGE DISPLACEMENT

| LOAD VALUE OF THE PRESSURE ROLLER (Kg) | WHETHER IMAGE DISPLACEMENT OCCURRED OR NOT |
|---|---|
| 0 | *** |
| 5 | *** |
| 10 | * |
| 15 | * |
| 20 | * |
| 25 | * |
| 30 | * |

* IMAGE DISPLACEMENT OCCURRED

** IMAGE DISPLACEMENT OCCURRED BUT THERE WAS NO PROBLEM IN RESPECT OF IMAGE QUALITY.

*** NO IMAGE DISPLACEMENT

FIXING DEVICE

FIELD OF THE INVENTION

The present invention relates to what is called a heating roller type fixing device which fixes an unfixed toner image on a recording medium by contact heating, in an image forming apparatus such as a copying machine, a facsimile machine or a printer.

BACKGROUND OF THE INVENTION

Conventionally, an unfixed toner image transferred to a recording medium is required to be fixed permanently by an image forming apparatus such as a copying machine and a printer, and Japanese unexamined patent publications Sho 5269337 (1977), 60-151677 (1985), 60-151681 (1985), 62-14675 (1987), Japanese unexamined utility model publications Sho 60-104852 (1985) and Hei 2-30961 (1990) describe fixing devices, wherein high quality fixing of even a color image having a large amount of unfixed toner is carried out by passing a recording medium having a transferred unfixed toner image thereon through a long contact portion formed between the fixing roller and an endless belt contacting the roller under pressure, and applying heat and pressure to the unfixed toner image for a long time.

Although the above described fixing device carries out high quality fixing of even a color image having a large amount of unfixed toner, especially when fixing a color image having a large amount of unfixed toner, because of the tendency of the toner to act as an adhesive, and for the recording medium to stick to the fixing roller, a stripper claw is required to positively strip the recording medium from the fixing roller . This stripper claw, however, has a tendency to damage the image fixed on the recording medium and impair the image quality.

The present inventors have proposed the following fixing device to solve this problem in Japanese patent application No. Hei 3-252097.

This is, as shown in FIG. 7, what is called a belt contact fuser for a fixing device using a thermal fixing roller, which fixes unfixed toner image 101 transferred to a transfer medium 100 and comprises a thermal fixing roller 103 with an elastic body 102 having a thickness of at least 0.5 mm applied thereon, a heat resistant belt 108 supported by a plurality of support rollers 104 to 107, and wherein the heat resistant belt 108 is made to contact the fixing roller 103 to make a contact portion extending over a certain angular range. A pressure roller 107 is disposed inside the heat resistant belt 108 at the exit point of the contact portion and it bears against the thermal fixing roller 103 under pressure through the heat resistant belt 108, such that distortion is caused in the elastic body 102 of the thermal fixing roller 103.

This belt contact fixing device can be applied not only to a monochrome but also to a color copying machine, in which distortion is caused in the elastic body 102 of the thermal fixing roller 103 by making the pressure roller 107 contact the thermal fixing roller 103 through the heat resistant belt 108 and the distortion allows the recording medium to strip from the thermal fixing roller 103 by its own stiffness. With this fixing device, a stripping means such as a stripper claw is not necessary at the exit point of the contact portion even in fixing a color image having a large amount of toner and transferred to a thin recording medium having a poor stiffness. This behavior, wherein the recording medium is stripped without a stripping means at the exit point of the contact portion, is called self-stripping.

The above described prior art, however, has a problem. This prior art comprises a heat resistant belt 108 contacting the fixing roller 103 over a specified angular range such that a contact portion is formed and a pressure roller 107 is disposed inside the heat resistant belt 108 at the exit point of the contact portion, and with this device, distortion is caused in the elastic body 102 of the thermal fixing roller 103 by making the pressure roller 107 bear against the thermal fixing roller 103 under pressure through the heat resistant belt 108.

When experimenting with the construction of this belt contact fixing device and carrying out a fixing test by varying the load value of the pressure roller 107, the present inventors found a new image defect. If the load of the pressure roller 107 is more than a specified value, the toner image 101 fixed on the transferred medium 100 is displaced.

FIG. 8 shows the relation between the image displacement and the load value of the pressure roller as found by experiment.

The mechanism proposed for the image displacement phenomenon investigated by the present inventors is now described.

Generally, as shown in FIG. 9, if a pressure roller 121 is made to contact the surface of the elastic roller 120 under pressure, the surface of the elastic roller 120 is deformed by the contact pressure from the pressure roller 121. If distortion is caused in the surface of the elastic roller 120, the circumference thereof is increased by a corresponding amount. The circumference L before the distortion is caused, wherein r is the radius of the elastic roller 120, is:

$$L=2\pi r$$

and the circumference L' after the distortion is caused, wherein s is the amount of distortion is:

$$L'=2\pi r(1+\epsilon)$$

Accordingly, the amount of distortion is:

$$\epsilon=(L'-L)/L=(L'/L)-1$$

The surface speed of the elastic roller 120 is influenced by the distortion $\epsilon$, and if $\epsilon$ is caused in the direction around the circumference of the elastic body, the surface speed V in the portion where $\epsilon$ is caused is:

$$V=(1+\epsilon)V_0$$

Here, $V_0$ is the surface speed without distortion $\epsilon$, or in other words when $\epsilon=0$.

With the belt contact fixing device according to the above described proposal, distortion is caused in the direction around the circumference by the load from the pressure roller 107 at the exit point, and there is a small difference between the surface speed V in the portion where the distortion is caused and the surface speed $V_0$ at the point where only the belt 108 contacts the fixing roller and having a value of $\epsilon$ of 0. If there is such a difference between the surface speed of the fixing roller 107 at the initial contact portion and that at the exit point of the belt contact portion, and the difference is greater than a specified value, the recording medium so far attached to the surface of the fixing roller cannot cope with the difference and is transported with the surface speed of the deformed portion, wherein the pressure roller 107 having a high contact pressure, that is a high transporting force, contacts the fixing roller, and thus image displacement is considered to be caused.

The amount of distortion on the surface of an elastic roller, which is caused by a specified load value, can be calculated. If a hard roller and a soft roller contact each other under pressure with a certain load value, the surface of the soft roller is elastically deformed in the contact portion, and distortion e is caused in the surface in the rotating direction of the roller. If a recording medium is passed through the contact portion by rotating the pair of rollers, the recording medium is transported through the deformed contact portion, which makes the length L', the transported length of the recording medium by a single rotation of the deformed elastic roller, longer than the original circumference L by an amount corresponding to $\epsilon$.

Here, the distortion $\epsilon$ is:

$\epsilon$=(the length L of a recording medium, which is transported by a single rotation of an elastic roller / the circumference, when $\epsilon=0$, of an elastic roller) $-1$ The actual distortion $\epsilon$ can be calculated by this formula, and values of distortion $\epsilon$ shown in this specification are calculated this way. When measuring the distortion $\epsilon$ using an actual belt contact fuser, it is necessary for the belt tension to be zero.

SUMMARY OF THE INVENTION

It is an object of the present invention to provide a fixing device free of defects found in the conventional art.

It is another object of the present invention to provide a fixing device which is capable of stripping a recording medium from the surface of the fixing roller without using a stripping means.

It is a further object of the present invention to provide a fixing device which is capable of preventing an image displacement caused by the distortion of the fixing roller.

It is a yet further object of the present invention to provide a fixing device comprising a fixing roller whose elastic body is made of a non-compressible material, which is a material whose volume does not vary when a pressure is applied.

Additional objects and advantages of the invention will be set forth in part in the description which follows and in part will be apparent to a person with ordinary skill in the art from the description, or may be learned by practice of the invention.

The present invention comprises a braking means which brakes the transport of an endless belt at the portion where the pressure roller bears against the fixing roller under pressure in the fixing device, which comprises a contact portion formed by making the fixing roller having an elastic body applied thereon contact a part of an endless belt supported by a plurality of rollers and including a contact portion formed by making a pressure roller disposed inside the endless belt bear against the fixing roller under pressure through the endless belt at the exit point of the contact portion.

Both the fixing roller and the tension rollers of the endless belt, may have drive means and the transport speed of the endless belt may be specified to be lower than the surface speed of the fixing roller at the portion where the pressure roller bears against the fixing roller.

It is also possible for one of the fixing roller and the tension rollers of the endless belt to have a drive means and for the other to have a torque control means which controls the rotational torque as a braking means. The braking means may be provided in the tension rollers of the endless belt, and if the fixing roller rotates by being driven, it may be provided in the fixing roller side.

Further, the torque control means may comprise a torque limiter provided in the fixing roller or the tension rollers of the endless belt.

BRIEF DESCRIPTION OF THE DRAWINGS

The manner by which the above objects and other objects, features and advantages of the present invention are attained will be fully evident from the following detailed description when it is considered in light of the accompanying drawings, wherein:

FIG. 3 shows the tested values and the assessment.

DETAILED DESCRIPTION OF THE INVENTION

In the fixing device according to the present invention, a braking means which brakes the transport of the endless belt at the point where the pressure roller bears against the fixing roller is provided. As a result, even when the device is constructed so that at the exit point of the contact portion the pressure roller inside the endless belt bears against the fixing roller through the endless belt and deforms the fixing roller so that the transfer medium is stripped from the fixing roller by its own stiffness, it can brake the transport of the endless belt at the exit point, which prevents speeding up of the belt transport of the fixing belt by an amount corresponding to the deformation of the elastic body, and thus, image displacement at the contact point is prevented.

EMBODIMENT

The present invention is now described referring to the embodiment shown in the figures.

Figure 1:
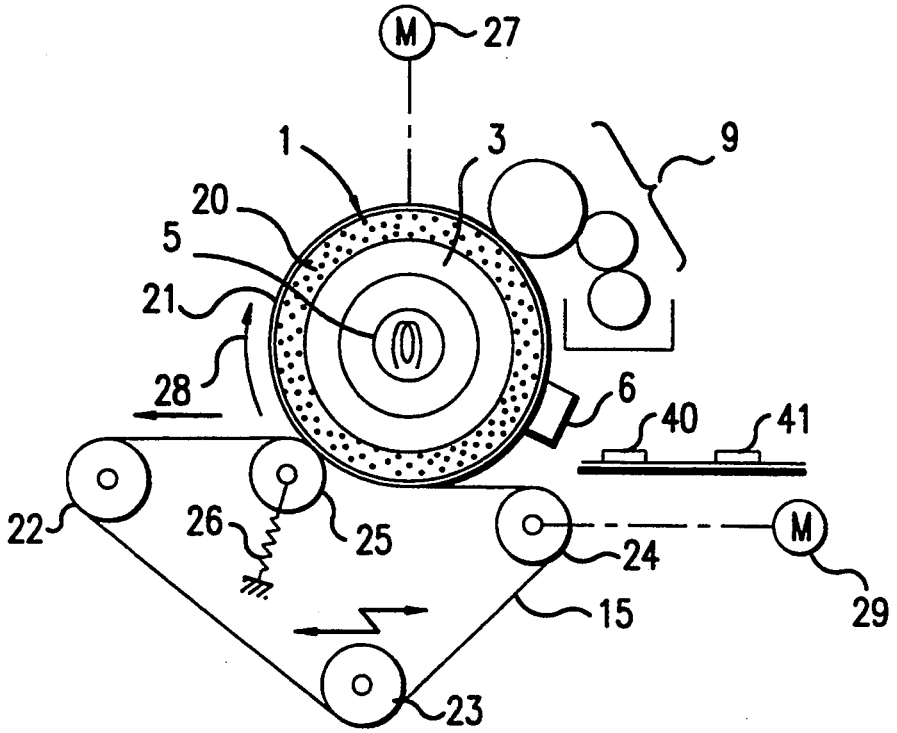
FIG. 1 shows an embodiment of the fixing device according to the present invention.

FIG. 1 shows an embodiment of the fixing device according to the present invention.

In FIG. 1, 1 is a thermal fixing roller and is rotated by a drive motor 27 at a specified speed of, for example 250 mm/second in the direction shown by the arrow 28. The thermal fixing roller 1 comprises an aluminum cylinder 3 having, for example, an outer diameter of 46 mm and a bore of 40 mm, a coating of HTV silicone rubber having a hardness of 45 durometer (durometer, according to JIS-A) and applied on the surface of the aluminum cylinder 3 as an elastic layer 20 to a thickness of 2 mm, a dip coating of RTV silicone rubber applied on the surface of the elastic layer 20 as a top coating layer 21 to a thickness of 50 μm, and the surface of the top coating layer 21 is finished to be close to a mirror finish.

A 400 W halogen lamp 5 is disposed inside the aluminum cylinder 3 as a heating source, and the thermal fixing roller 1 is heated by the halogen lamp 5, such that the surface thereof is heated to the specified temperature from inside. The surface temperature of the thermal fixing roller 1 is detected by the temperature sensor 6 contacting the surface of the thermal fixing roller 1, and the surface temperature of the thermal fixing roller 1 is controlled to be, for example, 423.15 K by a temperature controller which is not shown in the figure.

Further, dimethylsilicone oil having a viscosity of 300 cs (KF-96 available from Shin-Etsu Chemical Co., Ltd.) is supplied uniformly as a release agent from the release agent supply device 9 to the surface of the thermal fixing roller 1.

A heat resistant endless belt 15 is disposed to contact the surface of the thermal fixing roller I under pressure over a specified area. The endless belt 15 is made of, for example polyimide film having a thickness of 75 μm, a width of 300 mm and a circumference of 288 mm, and it is supported by four stainless steel rollers 22, 23, 24 and 25 with a tension of 10 kg. The diameters of the stainless steel rollers 22, 23, 24 and 25 are 22 mm, 20 mm, 20 mm and 18 mm respectively. The pressure roller 25 having a diameter of 18 mm is urged preferably toward the center of the fixing roller 1 by a compression coil spring 26 as a pressing means and makes the belt 15 contact the fixing roller 1 under pressure. The angle subtended at the center of the fixing roller 1 by the interval of the entire contact portion is 45°, and here, the length of the entire contact portion is 19.6 mm. As the pressure roller 25 is urged against the fixing roller 1 through the belt 15 under a load value of 20 kg, the elastic layer 20 of the fixing roller 1 is deformed, and distortion $\epsilon$ is caused in the surface thereof.

The distortion $\epsilon$ caused in the surface of the fixing roller 1 is, as described above, calculated by the following formula.

$\epsilon$=(the length L of a recording medium, which is transported by a single rotation of the fixing roller 1 / the circumference, when $\epsilon=0$, of the fixing roller 1) −1

Here, the amount of distortion s caused in the surface of the fixing roller 1 is measured with zero tension in the belt 15.

In this embodiment, the fixing device is structured to comprise a braking means to brake the transport of the endless belt at the point where the pressure roller bears against the fixing roller under pressure.

Of the four stainless steel rollers 22, 23, 24 and 25, which support the heat resistant endless belt 15, the stainless steel roller 24 disposed just upstream of the pressure roller 25 is connected with a drive motor 29, it is driven by the motor individually at a specified speed, and it applies a specified amount of braking force to the endless belt 15 contacting the fixing roller 1 under pressure.

In more detail, the fixing roller 1 is rotated by the drive motor 27 at a speed $V_0$=250 mm/second. Since a distortion $\epsilon$ of, for example 4 percent required for self-stripping, is caused in the surface of the fixing roller 1 at the portion where the pressure roller 25 bears against it, if the tension of the belt 15 is zero, the surface speed $V\epsilon$ of the fixing roller 1 at the contact portion is $V\epsilon$=260 mm/second. If the tension of the belt 15 is in fact 10 kg, with other conditions unchanged and the belt 15 is driven, the rotation speed of the belt 15 at the contact point was found to be 254 mm/second.

If the stainless steel roller 24 disposed just upstream of the pressure roller 25 among the four stainless steel rollers 22, 23, 24 and 25, which support the heat resistant endless belt 15, is forcibly rotated by its own drive motor 29, at a speed lower than that of the belt 15 at the contact portion, a specified amount of braking force is applied to the endless belt 15 contacting the fixing roller 1 under pressure, and the difference of speed caused at the portion where the fixing roller 1 contacts the endless belt 15 is reduced as much as possible, which prevents the displacement of an image fixed in the contact portion.

In the fixing device according to this embodiment, displacement of an image is thus prevented. In the fixing device, as shown in FIG. 1, a recording medium 41 having a toner image 40 thereon is passed between the thermal fixing roller 1 and the endless belt 15, and while passed through the contact portion, the toner image 40 is fixed on the recording medium 41 by heat and pressure.

Figure 2:
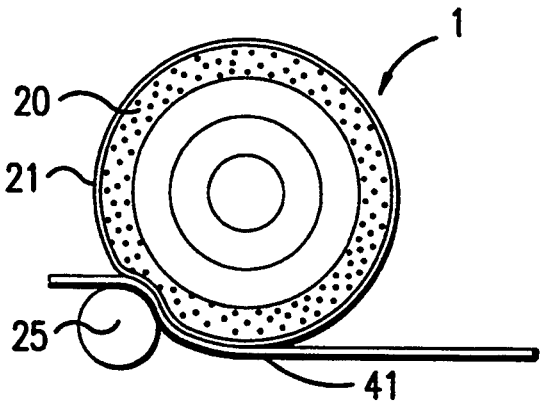
FIG. 2 shows how a recording medium is stripped from the fixing roller.

The recording medium 41 whose toner image was fixed in the contact portion between the thermal fixing roller 1 and the endless belt 15 is, while passing the pressure roller 25 making the endless belt 15 contact the surface of the fixing roller 1, curved in a concave shape, as shown in FIG. 2, in the flow direction of the recording medium by the pressure roller 25. As the tip of the recording medium 41 is distorted in the concave shape in the flow direction of the recording medium, the recording medium 41 is stripped from the surface of the fixing roller 1 by its own stiffness, which is called self-stripping, and it is fed out from the fixing device, following the endless belt 15. Accordingly, even in fixing a color image having a large amount of toner to be fixed on the recording medium 41, it is possible to strip the recording medium 41 from the surface of the thermal fixing roller 1 without using a stripping means such as a stripper claw.

In the above described fixing device, the roller 24 disposed just upstream of the pressure roller 25, among the rollers 22, 23, 24 and 25, which support the endless belt 15, is rotated by its own drive motor 29 at a specified speed lower than the rotation speed of the thermal fixing roller 1.

The fixing roller 1 is rotated in the direction shown by an arrow 28 by the drive motor 27 at a speed of, for example, $V_0$=250 mm/second. Here, as distortion $\epsilon$ of, for example 4 percent, is caused in the surface of the fixing roller 1 at the contact portion with the pressure roller 25, the surface speed $V\epsilon$ of the fixing roller 1 at the contact portion is, with a tension of the belt 15 of zero, $V\epsilon$=260 mm/second. If the tension of the belt 15 is in fact 10 kg with other conditions unchanged, the belt 15 is driven at a speed of 254 mm/second. The stainless steel roller 24 disposed just upstream of the pressure roller 25, among the four stainless steel rollers 22, 23, 24 and 25 supporting the belt 15, is forcibly rotated by its own drive motor 29, at a speed lower than that of the belt 15 at the contact portion. This makes a specified amount of braking force applied to the endless belt 15 contacting the fixing roller 1, and the difference of speed caused in the portion where the fixing roller 1 contacts the endless belt 15 is reduced as much as possible, which prevents displacement of an image to be fixed in the contact portion.

The present inventors, to confirm the effects of the fixing device according to the present invention, made a fixing device as shown in FIG. 1 under the conditions described in the above described embodiment and investigated whether image displacement occurred or not.

FIG. 3 shows the assessment of the test, and in it, ** shows that image displacement occurred but there was no problem in respect of image quality.

As is apparent from the figure, if the ratio $a / \epsilon$, wherein a is the reduction of the belt speed with respect to the driven speed and $\epsilon$ is the distortion caused in the surface of the fixing roller 1 is such that:

$$1/20 \leqq a/\epsilon \leqq 7/10$$

and more preferably such that: $2/10 \leqq a/\epsilon \leqq 5/10$, then image displacement is positively prevented.

These conditions are stated in terms of the ratio $a / \epsilon$ of the reduction of the belt speed with respect to the driven speed and the distortion caused in the surface of the fixing roller 1, in order to specify the range, for which image displacement is prevented independently of the belt speed, diameter of the pressure roller 25 and pressing force.

If the tension roller 24 is rotated forcibly and the roller has a smooth metal surface, slipping may occur at the interface with the belt 15. To prevent such slipping, in this embodiment, a dip coating of RTV silicone rubber is applied on the surface of the tension roller 24 to a thickness of 100 μm. Here, as the friction coefficient with the belt 15 increases from 0.15 to 0.9, slipping is prevented completely.

In this embodiment, the fixing roller 1 and the belt 15 are driven by separate motors, but it is also possible to distribute the drive force by a motor, using a gear or a chain, such that the speed rate is optimal.

EMBODIMENT 2

Figure 4:
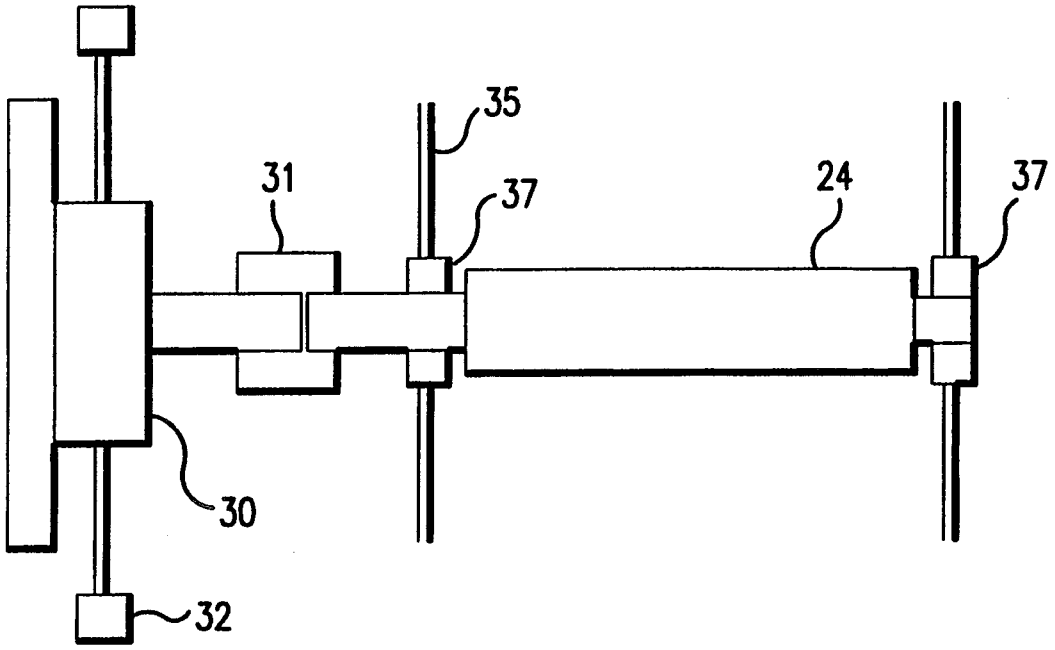
FIG. 4 shows the main portion of another embodiment of the fixing device according to the present invention.

FIG. 4 shows embodiment 2 of the present invention, and the same portions as shown in the above described embodiment are identified by the same reference indications. In this embodiment, the fixing device is structured to comprise a torque control device for the belt. Generally, the torque control device may be a contact type using mechanical frictional force or a non-contact type using an exciting coil and a permanent magnet.

Figures 5, 6:
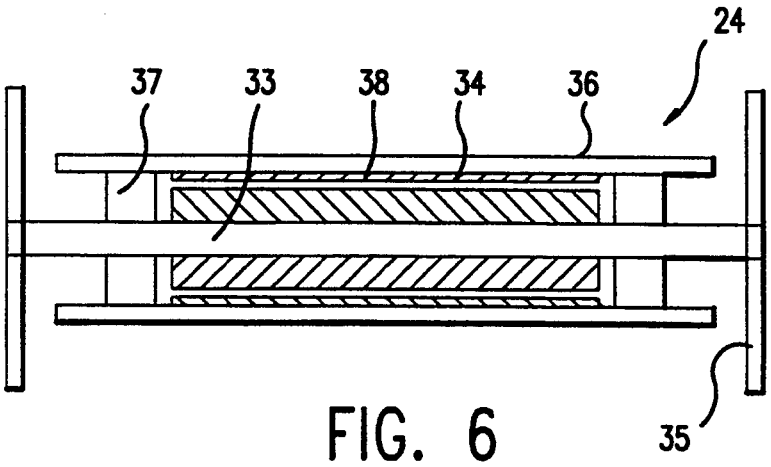
FIG. 5 shows the tested values and the assessment.
FIG. 6 shows the main portion of yet another embodiment of the fixing device according to the present invention.
Figures 7, 8:
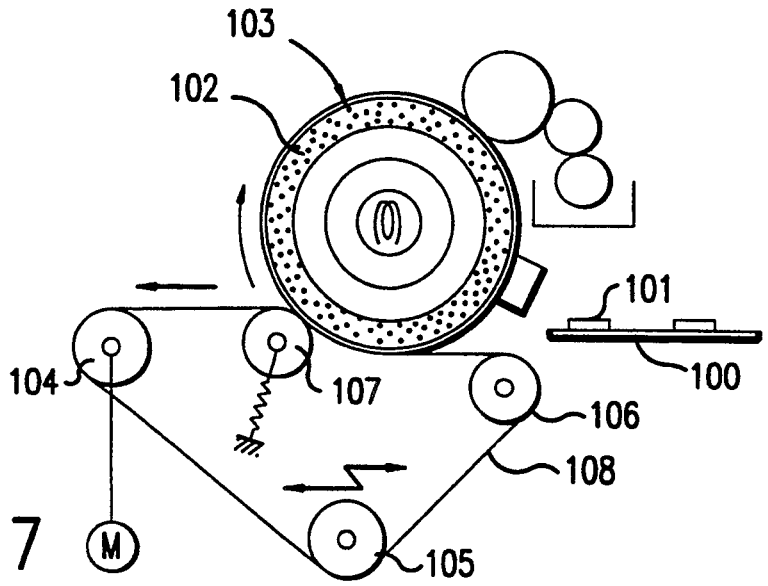
FIG. 7 PRIOR ART
FIG. 7 shows a conventional fixing device.
FIG. 8 shows the relation between the load value of the pressure roller and whether or not image displacement occurred.
Figure 9:
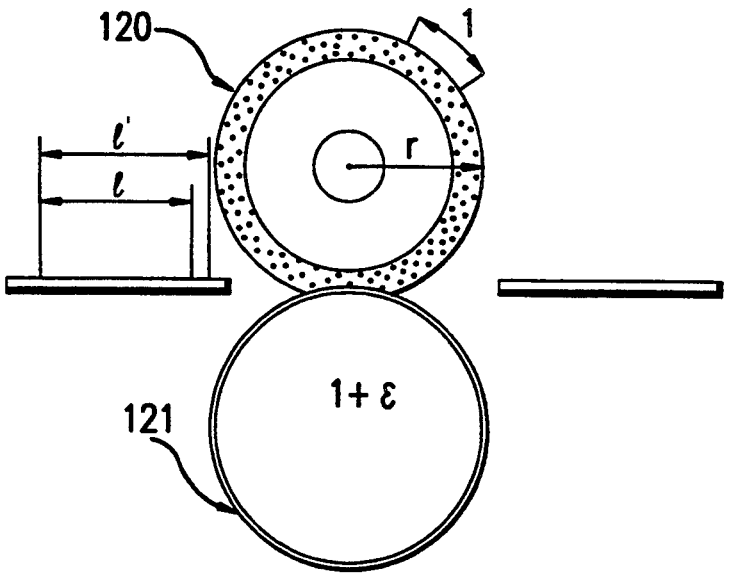
FIG. 9 shows how the fixing roller is deformed.

In this embodiment, as shown in FIG. 4, a solenoid operated braking device 30 whose braking force is variable is disposed as a torque control device at the end of the tension roller 24 by means of a coupling member 31. The solenoid operated brake 30 controls the braking torque by varying the current 32 entering the exciting coil. FIG. 5 shows an assessment of the relation between the braking torque and the occurrence of image displacement. The structure and the condition of the fixing device are the same as in embodiment 1, and in the figure, ** shows that image displacement occurred but there was no problem in respect of image quality.

If the torque T (kg/cm) obtained by multiplying the load value of the pressure roller W (kg) by the radius of the fixing roller R (cm) is considered as a standard value, in this embodiment, $T=20\times2.5=50$ kg/cm. If the amount of applied braking torque is 1 percent of the standard value, effects of image displacement prevention begin to be shown, and if it is 4 percent or more, the effects are shown completely. If the amount of applied braking torque exceeds 4 percent, even if image displacement does not occur, the total amount of torque to drive the fixing device is increased, which is a waste of mechanical energy. Accordingly, the optimal amount of torque is 4 to 10 percent of the standard value, in this embodiment 2.0 to 5.0 kg/cm. This braking torque brings the difference of speed inside the belt contact close to zero, and thus image displacement is prevented.

As other structures and functions are the same as the above described embodiment, the descriptions thereof are omitted.

EMBODIMENT 3

FIG. 6 shows embodiment 3 of the present invention, and the same portions as shown in the above described embodiments are identified by the same reference indications. In this embodiment, the fixing device is structured to comprise a torque limiter inside the tension roller 24, and in view of the assessments of embodiment 2, a torque limiter having a rated value of 3.0 kg/cm is used. FIG. 6 is the cross-sectional view, wherein a torque limiter is provided inside the tension roller 24. A permanent magnet 34 is incorporated in the center of the fixed axis 33 of the tension roller 24, and both end portions of the fixed axis are supported by frames 35 of the belt module. The outer cylinder 36 of the tension roller 24 is rotatably supported by bearing members 37 at its both end portions, and it is rotated centered on the fixed axis 33. A ferro-magnetic material 38 is provided inside the outer cylinder 36, and the braking torque which is caused when the outer cylinder 36 is rotated centered on the fixed axis 33 is a hysteresis torque caused by the combination of the permanent magnet 34 and the magnetic material 38, namely it is the torque caused by the phase of the magnetic property. This produces a braking torque of 3.0 kg/cm, independent of the rotation speed, and as this braking torque brings the difference of speed inside the belt contact close to zero, image displacement is prevented.

As other structures and functions are the same as the above described embodiments, the descriptions thereof are omitted.

As described so far, this invention shows a solution for image displacement, which is a problem of a belt contact fuser and an art to realize it.

Image displacement is prevented by bringing the difference of speed inside the belt contact as close to zero as possible, using a means specifically described in embodiment 1 to 3.

This invention includes not only the described three specific embodiments but also other configurations of the drive mechanisms for the fixing roller and the belt and torque control devices for the belt relating to them, within the limitation of the present invention.

What is claimed is:

1. A fixing device, comprising: a contact portion formed by making a part of an endless belt supported by a plurality of tension rollers contact a fixing roller having an elastic body applied thereon, the contact portion including a contact point formed by making a pressure roller inside the endless belt bear against the fixing roller under pressure through the endless belt at an exit point of the contact portion; and a braking means for braking the transport of the endless belt at the contact point.

2. The fixing device of claim 1, wherein one of the fixing roller and tension rollers of the endless belt has a drive means and the other of the fixing roller and tension rollers has a torque control means which controls a rotational torque as the braking means.

3. The fixing device of claim 2, wherein the torque control means is a torque limiter attached to the fixing roller and tension rollers of the endless belt.

4. A fixing device, comprising a contact portion formed by making a part of an endless belt supported by a plurality of tension rollers contact a fixing roller having an elastic body applied thereon, the contact portion including a contact point formed by making a pressure roller inside the endless belt bear against the fixing roller under pressure through the endless belt at an exit point of the contact portion; and a braking means which brakes the transport of the endless belt at the contact point, wherein said braking means causes the endless belt at the point where the pressure roller bears against the fixing roller to move at a speed greater than the remaining portions of the endless belt.

5. The fixing device of claim 4, wherein both of the fixing roller and the tension rollers of the endless belt have drive means.

6. The fixing device of claim 4, wherein one of the fixing roller and tension rollers of the endless belt has a drive means and the other of the fixing roller and tension rollers has a torque control means, wherein the torque control means operates as the braking means by controlling a rotational torque of the fixing and tension rollers.

7. The fixing device of claim 6, wherein the torque control means is a torque limiter attached to one of the fixing roller and tension rollers of the endless belt.

* * * * *